US005931385A

United States Patent [19]

Miller

[11] Patent Number: 5,931,385

[45] Date of Patent: Aug. 3, 1999

[54] DOME SHAPED COVER FOR A LAWN SPRINKLER HEAD

[76] Inventor: Howard W. Miller, 2326 Fairoyal, St. Louis, Mo. 63131

[21] Appl. No.: 08/438,533

[22] Filed: May 10, 1995

[51] Int. Cl.[6] ..... B05B 1/28

[52] U.S. Cl. ..... 239/288; 239/288.3; 239/288.5

[58] Field of Search ..... 239/288, 276, 239/288.3, 288.5, 201, 203–206

[56] References Cited

U.S. PATENT DOCUMENTS

| | | | |
|---|---|---|---|
| 1,110,593 | 8/1914 | Munson | 239/288 |
| 2,751,250 | 6/1956 | Block | 299/60 |
| 3,265,310 | 8/1966 | Cohen | 239/210 |
| 3,514,040 | 5/1970 | Carson | 239/288.5 |
| 3,904,120 | 9/1975 | Sbicca . | |
| 4,146,181 | 3/1979 | Soos . | |
| 4,212,426 | 7/1980 | Choi . | |
| 4,582,256 | 4/1986 | Jaquez . | |
| 5,037,030 | 8/1991 | Apodaca . | |
| 5,211,338 | 5/1993 | Leite et al. . | |
| 5,222,669 | 6/1993 | Lawson . | |

*Primary Examiner*—Robert J. Oberleitner
*Assistant Examiner*—C. T. Bartz
*Attorney, Agent, or Firm*—Polster, Lieder, Woodruff & Lucchesi

[57] ABSTRACT

The present invention relates to a cover for a sprinkler head the sprinkler system being associated with a lawn system. The cover is a dome shaped disk with a center aperture to accommodate the sprinkler head. At least three conically shaped posts are attached on the under side of the cover to anchor the cover to the ground.

3 Claims, 1 Drawing Sheet

FIG. 1
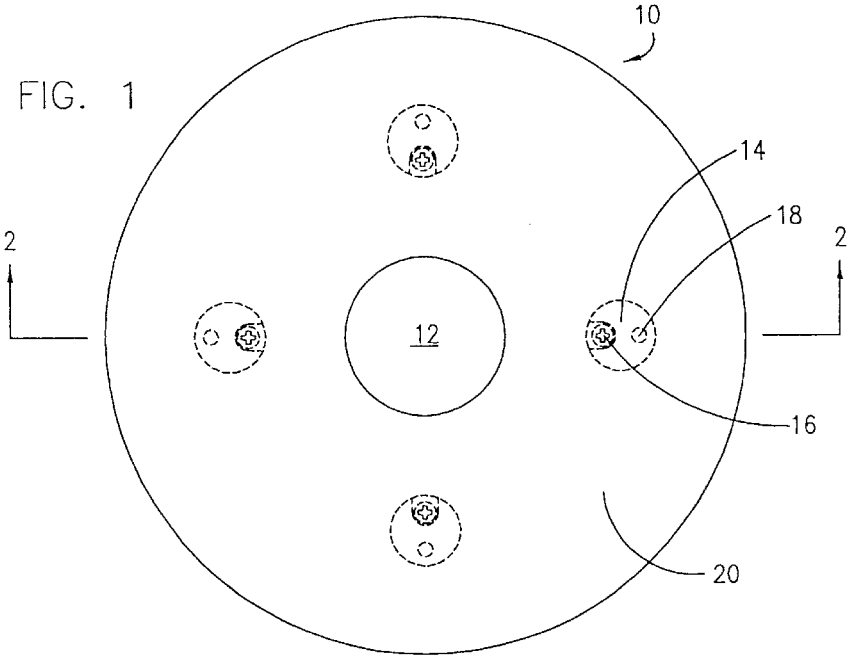
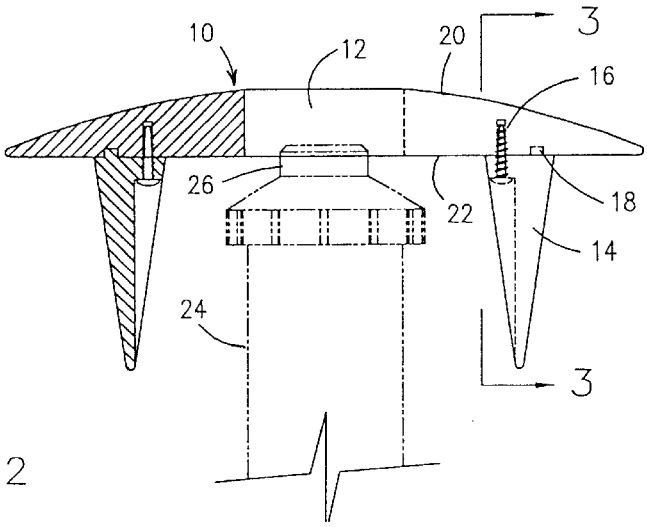
FIG.2
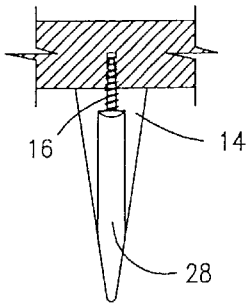
FIG. 3

DOME SHAPED COVER FOR A LAWN SPRINKLER HEAD

BACKGROUND OF THE INVENTION

Sprinkler systems for residential lawns have become very popular so as to provide watering of the grass on a scheduled frequency. The typical sprinkler head mechanism allows the operating portion of the head to spring upward from the ground a few inches to allow the water to spray about in a pre-selected pattern so as to water a relatively wide area.

While there are many types of sprinkler heads, a common type includes a base, a spray nozzle and a poppet attaching the spray nozzle to the base. When water pressure is applied to the sprinkler head through the riser, the poppet is caused to move from a retracted to an extended position elevating the spray nozzle.

In a typical home installation, the sprinkler heads are mostly buried in the ground with only their upper surface being at ground level. The poppet elevates the spray nozzle above the ground level for effective dispersal of the water. A problem encountered with this type of installation is that it can be easily damaged by being stepped on, mowed over, or rolled over by varying pieces of equipment.

It has been found desirable to place the sprinkler heads about in a lawn generally around the periphery at the edge of the sidewalk, driveway, curbing, etc. Frequently, autos or heavy pieces of equipment roll over the sprinkler heads causing considerable damage thereto. Thus, various devices have been developed to try to protect the lawn sprinkler head. These devices frequently are complicated and expensive to produce and may be difficult to install. The present invention provides a simply designed cover for lawn sprinkler heads which is inexpensive to produce and easy to install.

SUMMARY OF THE INVENTION

The present invention provides a cover for lawn sprinkler heads comprising a circular disk having a dome-shaped upper surface and a flat bottom surface with a circular aperture in the center with a diameter sufficient to allow the sprinkler head operating portion to penetrate the cover and freely spray the intended region. At least three cone-shaped posts are attached to the flat side of the disk to allow the cover to be securely anchored to the ground.

The cone-shaped posts preferably are releasably attached to the bottom surface of the disk. Thus, when packaging the cover for sale, the posts can be included separately to allow for a smaller package. One method of making the posts releasable from the disk is to cut a notch in the side of the cone about one quarter inch from the thicker end of the cone to allow a screw to be placed in the notch so as to penetrate the one quarter inch thickness and extend into the bottom surface of the disk.

Preferably the cone-shaped post will have a slight round protrusion on the flat end of the thicker end of the cone to be mated with a hole in the bottom flat surface of the disk so as to hold the post in position when attaching the post to the disk. The disk is a single molded piece generally of plastic approximately one inch thick at its thickest point with the surface tapering downwardly to the edge of the disk thus providing the dome shape. The aperture in the center is generally at least about two inches in diameter to accommodate the average lawn sprinkler head. The overall diameter of the cover is generally about nine inches, more or less.

It is suggested that the posts be at least about three inches in length and that the cone taper to a reasonably sharp point so as to make installation in the ground simple by merely pushing the device down to the surface of the ground.

BRIEF DESCRIPTION OF THE DRAWINGS

FIG. 1 is a top view of one embodiment of the present invention;

FIG. 2 is a side elevational view taken along line 2—2 of FIG. 1; and FIG. 3 is a side elevational view taken along line 3—3 FIG. 2.

DETAILED DESCRIPTION OF THE INVENTION

FIG. 1 depicts one embodiment of the invention from a top view showing that the sprinkler head cover is a circular disk 10 having an aperture 12 located in the center of the disk. The aperture 12 is sufficiently wide to accommodate the sprinkler head 26 depicted in FIG. 2. The surface 20 of the disk is dome shaped. Also depicted in FIG. 1 is a top view of the post 14 which extends below the bottom surface 22 of the disk. The post 14 is fastened to the bottom surface 22 of the disk 10 and is held in position by a protrusion 18 extending into a position notch in the bottom surface 22 of the disk 10.

FIG. 2 is a side elevational view taken along lines 2—2 of FIG. 1. In FIG. 2, the dome shaped surface 20 is readily apparent. The surface 20 slopes downwardly from the center portion of the disk to the outside edge where it meets the flat bottom 22 of the disk. A sprinkler shaft 24 is depicted exhibiting a head 26. The head 26 is shown in the position in which it would appear centered in the aperture 12. The head 26 is the portion which rises through the aperture 12 and when the sprinkler system is activated it extends above the sprinkler head cover 10 and sprays the peripheral about the sprinkler head cover 10. The post 14 extends into the ground and is conically shaped to a reasonably sharp point to allow easy insertion into the ground.

FIG. 3 is a view of the post 14 taken along line 3—3 of FIG. 2. The post 14 is affixed to the bottom surface 22 of the disk cover 10 by means of a screw 16. The conical post 14 is also provided with a groove 28 to allow accommodation of the screw 16.

The sprinkler head cover of the present invention should have a diameter sufficient such that the cover, when pressure is applied, will not be pressed into the ground. The sprinkler head cover is generally made of a plastic material having sufficient resiliency so as not to break under weight or under temperature changes. It is anticipated that the sprinkler head cover, once it is placed surrounding a sprinkler head would not be removed but would simply remain in place unless, of course, repairs to the sprinkler system are required.

Most generally, the diameter of the cover will be approximately nine inches, perhaps more, perhaps less. The opening or aperture in the center of the cover is sufficient to accommodate whatever sprinkler head will be penetrating the aperture. In order to provide a cover to allow a difference in aperture diameter a doughnut-type disk having a flange to prevent its rising up through the aperture can be placed inside the aperture to decrease the size or if marketed with the doughnut disk in place, the doughnut disk is removed to enlarge the size of the aperture.

The conical posts should be present in a number of at least three, however more can be provided to further stabilize the sprinkler head cover when the posts have been inserted into the ground. The dome shape of the surface of the cover allows vehicles or footsteps when encountering the cover to rise up onto the surface of the cover without dislodging the cover thus providing complete protection for the sprinkler head. This permits the sprinkler heads to be installed immediately adjacent the edge of a curve, a driveway, or a curb without fear of the sprinkler head being damaged. It is easy to trim any grass near the sprinkler head cover, and the shape and placement of the cover tends to prevent grass from growing under the cover where growth of grass might interfere with the operation of the sprinkler head.

While a particular form of the invention has been illustrated and described, it will be apparent to those skilled in the art that various modifications can be made without departing from the spirit and scope of the invention.

I claim:

1. A cover for a lawn sprinkler head comprising a single molded piece forming a circular disk having a dome shaped upper surface and a flat bottom surface to be placed upon the surface of the ground, the disk having a central circular aperture of predetermined diameter which is sufficient to allow the operating portion of the sprinkler head to freely penetrate the aperture when operating, and at least three conically shaped posts attached to the bottom surface of the disk to extend into the ground to securely anchor the cover to the ground.

2. The cover of claim 1 wherein the posts are releasably attached to the bottom surface of the disk.

3. The cover of claim 1 wherein four posts are releasably attached to the bottom surface of the disk.

* * * * *